US005098020A

United States Patent [19]

Cooper et al.

[11] Patent Number: 5,098,020

[45] Date of Patent: Mar. 24, 1992

[54] ADJUSTABLE OSCILLATING WAVE-TYPE SPRINKLER

[75] Inventors: Randy J. Cooper, Santa Ana; Aaron D. DeLaby, Diamond Bar; Craig E. Beal, Bonsall; Glenn I. Beal, Vista, all of Calif.; Roger L. Hildwein, Loveland, Ohio

[73] Assignee: Rain Bird Consumer Products Mfg. Corp., Glendora, Calif.

[21] Appl. No.: 689,443

[22] Filed: Apr. 22, 1991

[51] Int. Cl.[5] ..... B05B 3/02; B05B 3/16

[52] U.S. Cl. ..... 239/230; 239/242

[58] Field of Search ..... 239/230, 231, 242, 225.1

[56] References Cited

U.S. PATENT DOCUMENTS 4,182,494 1/1980 Wichman et al. ..... 239/230

4,978,070 12/1990 Chow ..... 239/230

*Primary Examiner*—Andres Kashnikow

*Assistant Examiner*—Lesley D. Morris

*Attorney, Agent, or Firm*—Kelly, Bauersfeld & lowry

[57] ABSTRACT

An adjustable oscillating wave-type irrigation sprinkler having an impact or impulse drive type mechanism for effecting side-to-side oscillation by a spray tube about a horizontal axis, the drive mechanism including a pair of drive spoons coupled to impact arms journaled for rotation relative to the spray tube and intercepting streams of water from the spray tube to produce incremental rotation of the spray tube about the horizontal axis.

55 Claims, 7 Drawing Sheets

FIG. 5
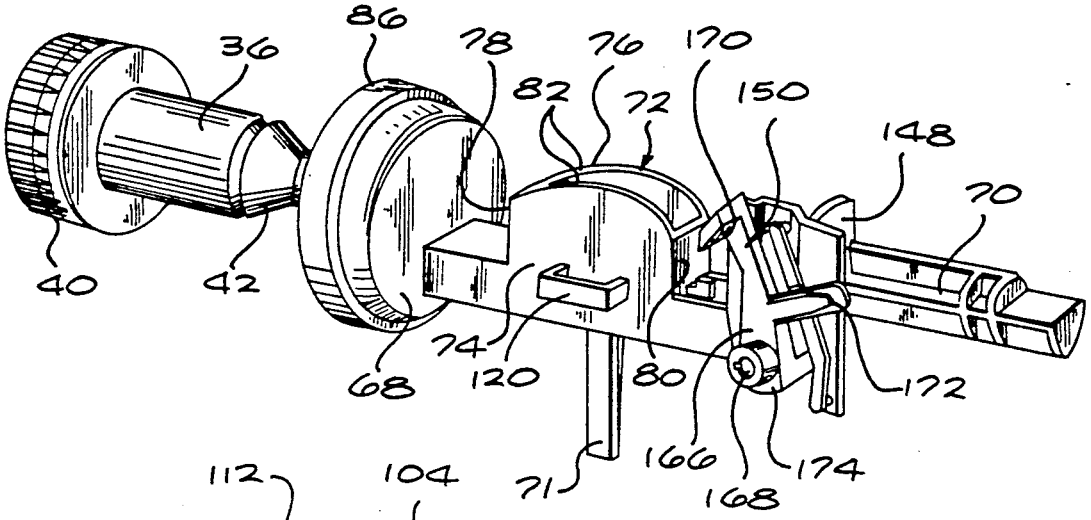
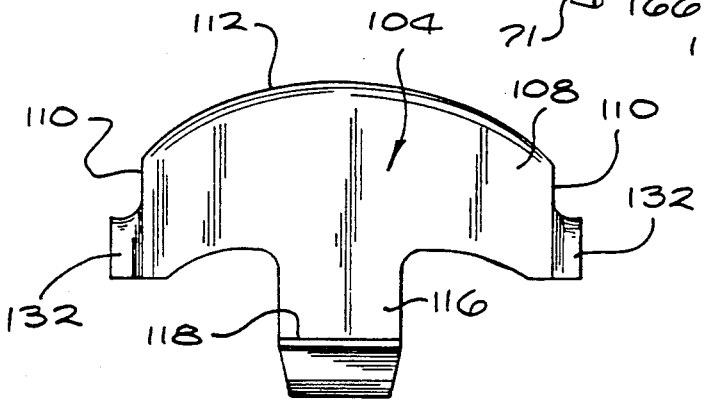
FIG. 6
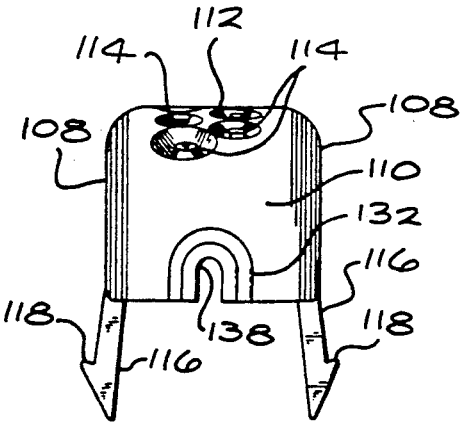
FIG. 7
FIG. 8
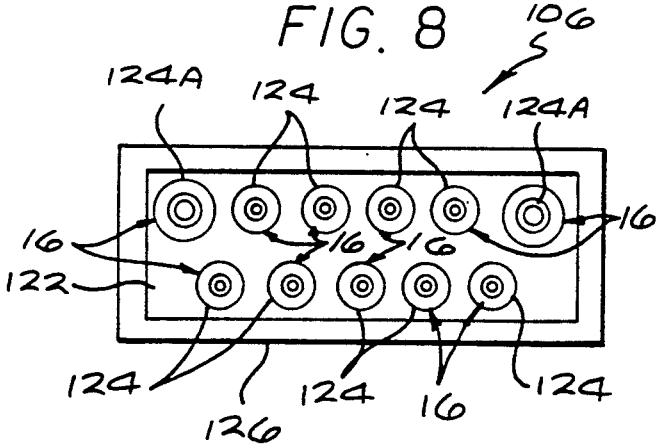

FIG. 9
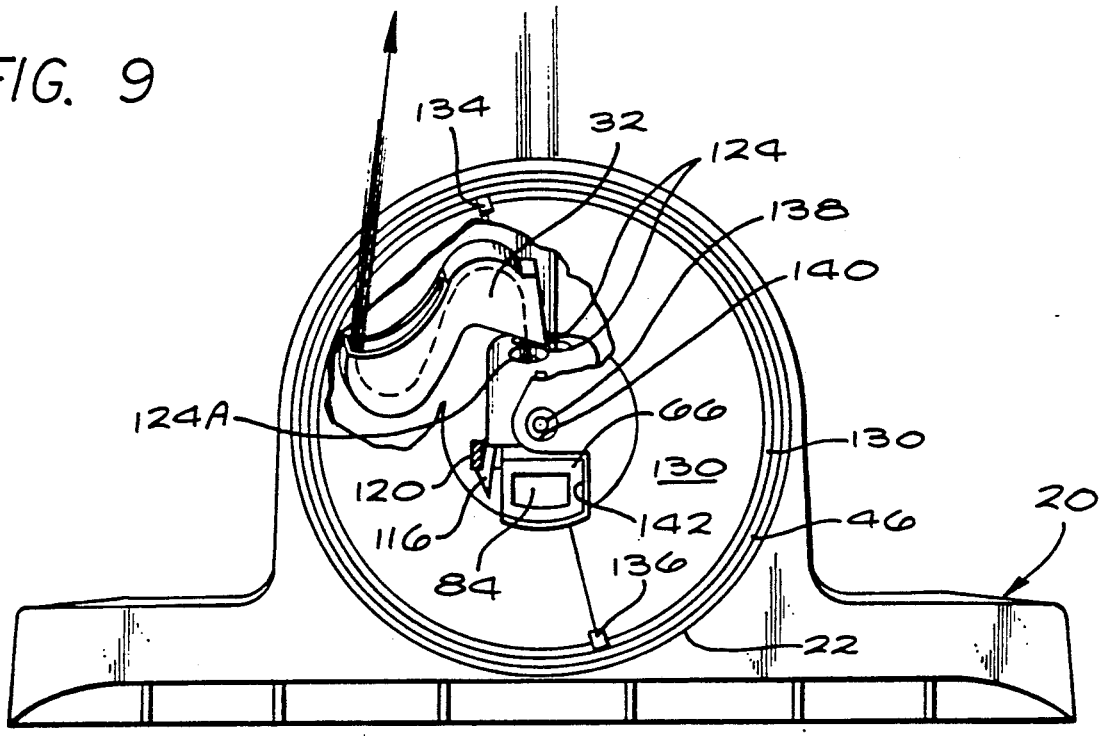
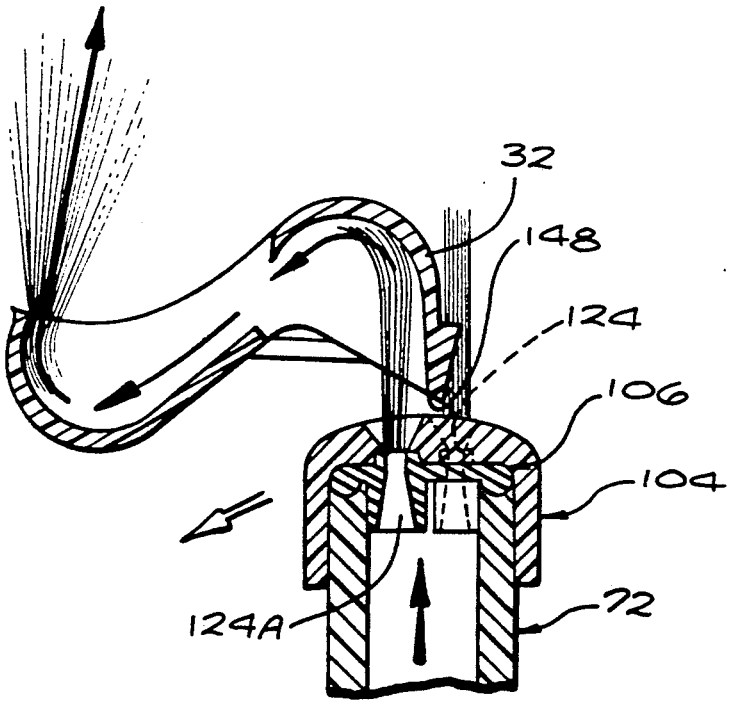
FIG. 10

FIG. 11
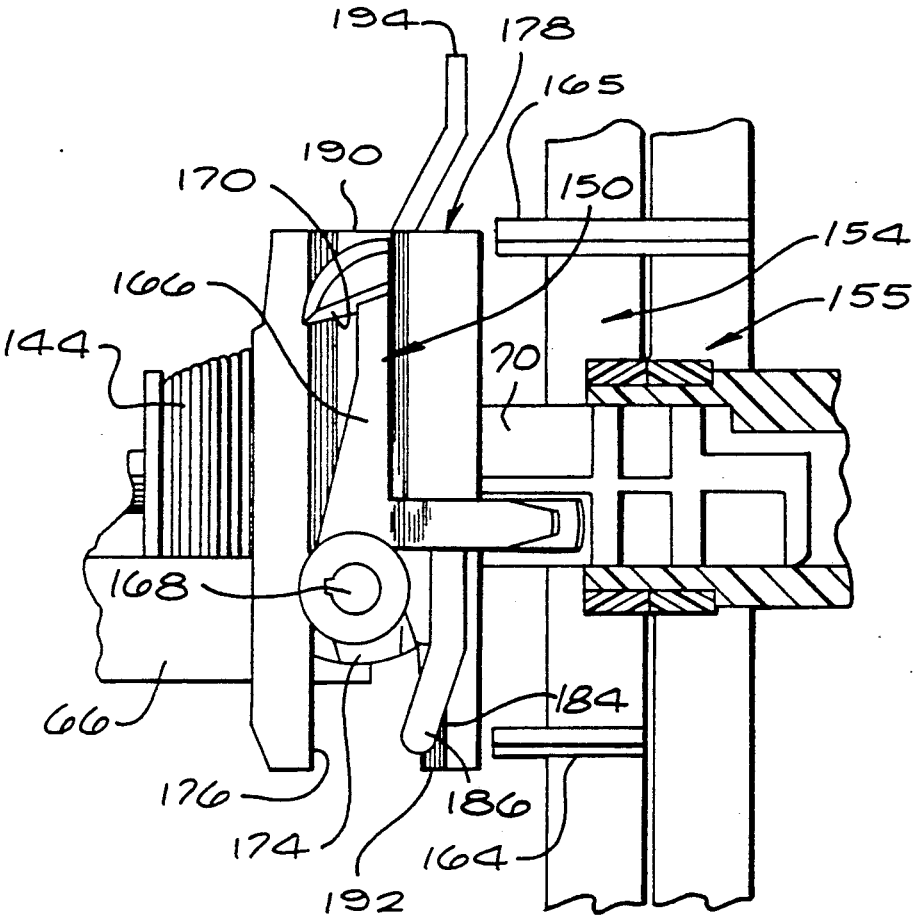
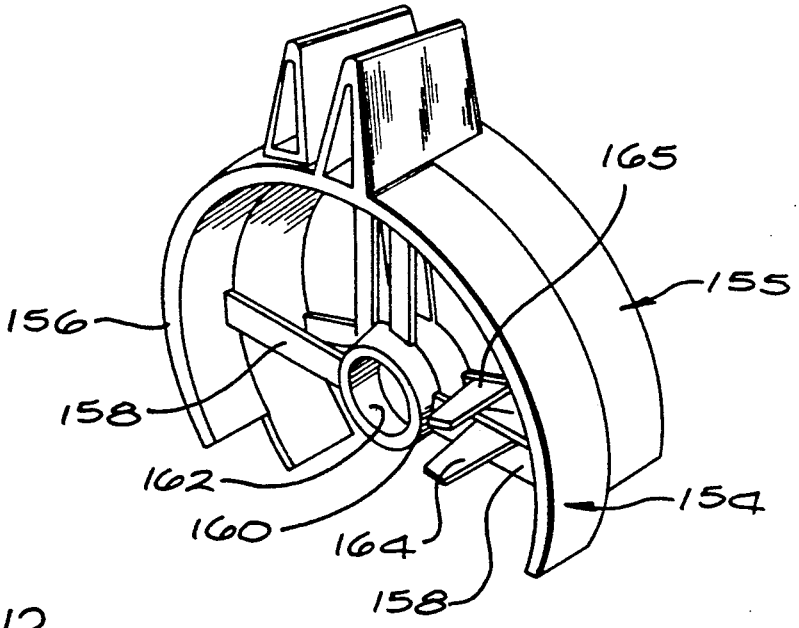
FIG. 12

ADJUSTABLE OSCILLATING WAVE-TYPE SPRINKLER

BACKGROUND OF THE INVENTION

This invention relates to irrigation sprinklers, and more particularly to a new and improved adjustable oscillating wave-type sprinkler primarily intended for use in irrigating lawns, flowers, shrubs, and the like.

Oscillating wave-type sprinklers have long been known and used in the irrigation field for watering lawns, gardens, shrubs, flowers, and other plants. Typically, such sprinklers include a water-driven motor mounted in a housing and which drives an elongated spray tube for side-to-side oscillation of about a generally horizontal axis. The spray tube, which usually is formed of thin gauge tubular material, has a plurality of water outlet openings or nozzles spaced along the length of the tube and disposed to project discreet water streams outwardly from the tube in a fan or wave-like spray pattern. As the spray tube oscillates about its axis, the fan-like spray produced by the outlets or nozzles translates back and forth across the ground producing a general rain-like fall out to either side of the sprinkler.

Typically, the water-driven motor employed in conventional oscillating wave-type sprinklers have included water driven turbines or impellers coupled to the spray tube through reduction gearing and linkage mechanisms. Through use of cams and/or linkage adjustment, the back and forth oscillation of the spray tube has been controlled so that the spray tube will oscillate substantially uniformly back and forth over the ground area to be irrigated. Exemplary of such prior art oscillating wave-type sprinklers are those marketed by Rain Bird Sprinkler Mfg. Corp. of Glendora, Calif. as, for example, depicted at page 5 of its 1989 Rain Bird Consumer Products Catalog.

One problem inherent in most oscillating wave-type sprinklers is that the distribution pattern of water over the ground tends to be confined to discreet narrow strips or bands formed on each side of the spray tube where the individual water sprays from each outlet or nozzle regularly fall to the ground. One effort to solve this problem which has met with significant commercial success has been the oscillating wave-type sprinklers manufactured by Rain Bird Sprinkler Mfg. Corp. in accordance with U.S. Pat. No. 4,860,954 issued Aug. 29, 1989 and entitled ADJUSTABLE OSCILLATING WAVE-TYPE SPRINKLER. That patent illustrates and describes an oscillating wave-type sprinkler employing a conventional water-driven motor for oscillating an elongated spray tube, and which includes a throttling mechanism for cyclically throttling the water flow to the spray tube so that the spray pattern from each nozzle cyclically moves radially inwardly and outwardly relative to the spray tube. This has been found to enhance the uniformity of water distribution pattern so as to not leave unwatered or underwatered strips along the length of the fan-shape spray as the spray tube oscillates.

Another problem inherent in most oscillating wave-type sprinklers is that the spray pattern produced does not result in well defined corners so that the pattern is rounded rather than more rectangular, as is desirable for oscillating wave-type sprinkler uses. A still further problem encountered by many prior art oscillating wave-type sprinklers is that of over watering at the extremes of the oscillating spray pattern during reversal of the direction of spray tube rotation. Prior art attempts at overcoming this problem have included the use of heart shaped cams and other linkage mechanisms to attempt to accelerate the speed of rotation during spray tube direction transition. Exemplary of oscillating sprinkler mechanisms of this type is that disclosed in U.S. Pat. No. 3,261,553 issued to Kooi et al July 19, 1966 entitled OSCILLATING LAWN SPRINKLER.

Still further problems inherent in many prior art oscillating wave-type sprinklers is that the water driven turbines or impellers rotate at very high speeds which necessitate the use of reduction gearing to control the rate of spray tube oscillation, thereby adding to the cost of manufacture and assembly, and reducing efficiency of operation.

Thus, there exists a need for a new and improved oscillating wave-type sprinkler which is capable of producing a precise rectangular spray pattern of various sizes, and which will uniformly apply irrigating water over the entire area irrigated. As will become more apparent from the following, the present invention meets this need in a novel and unobvious manner.

SUMMARY OF THE INVENTION

The present invention provides an oscillating wave-type irrigation sprinkler which is relatively simple and compact in design, inexpensive to manufacture and assemble, yet which is highly efficient, reliable and effective in use for producing a uniform application of irrigating water over a precise rectangular shaped area of various sizes. The sprinkler of the present invention employs a unique drive mechanism for oscillating the spray tube about preselected arcuate limits, and which produces a substantially instantaneous oscillation direction reversal to insure that over watering at the extremes does not occur. Further, the drive mechanism allows the spray nozzles of the spray tube to be formed in such a manner as to produce a substantially precise rectangular shaped water pattern over the area to be irrigated, and insures that uniform water application over the entire area selected takes place.

More particularly, the oscillator of the present invention employs the principles of the well known impulse or impact drive type mechanism for producing oscillatory motion of the spray tube about a horizontal axis. The drive mechanism includes a drive spoon attached to an impact arm assembly which imparts intermittent, incremental rotation to the spray tube. A reversing trip mechanism is employed to cause the direction of rotation to reverse when the spray tube has reached the pre-set limits of rotation in a given direction, and is adjustable to permit selection and control of those preset limits.

The spray tube is formed to be very compact in size and includes a premolded resilient nozzle strip having spray nozzles arranged in side-by-side rows, and which is assembled in a nozzle housing to orient the nozzle passages to produce a fan or wave shaped spray pattern. An enlarged nozzle passage is formed in the nozzle strip to produce a stream that intercepts the drive spoon to effect rotation of the impact arm assembly for driving the spray tube about the horizontal axis, and which aids in promoting uniform water distribution over a precise rectangular area.

The various components making up the oscillator of the present invention can be formed as modular units from molded materials, and are made to be snapped together to facilitate ease of manufacture and assembly. These and various other features and advantages of the present invention will become more apparent from the following detailed description taken in conjunction with the accompanying drawings which disclosed, by way of example, the principles of the invention.

BRIEF DESCRIPTION OF THE DRAWINGS

FIG. 5 is an enlarged perspective view showing the spray tube assembly and reversing dog components from FIG. 4 in an assembled condition;

FIG. 6 is an enlarged side elevational view of a nozzle cap component shown in FIG. 4;

FIG. 7 is an end elevational view of the nozzle cap of FIG. 6;

FIG. 8 is an enlarged top plan view of a nozzle strip component shown in FIG. 4;

FIG. 9 is a sectional view taken substantially along the line 9—9 of FIG. 3 with hidden portions shown in cut-away end elevation, and schematically illustrating the path of water travel from the oscillator nozzles;

FIG. 10 is a fragmentary sectional view taken substantially along the line 10—10 of FIG. 3;

FIG. 11 is an enlarged fragmentary side elevational view showing the reversing dog and adjustment collar components from FIG. 4 in the assembled condition;

FIG. 12 is a perspective view of the adjustment collar components from FIG. 4 shown mated together prior to assembly;

DETAILED DESCRIPTION OF THE PREFERRED EMBODIMENT

Figure 1:
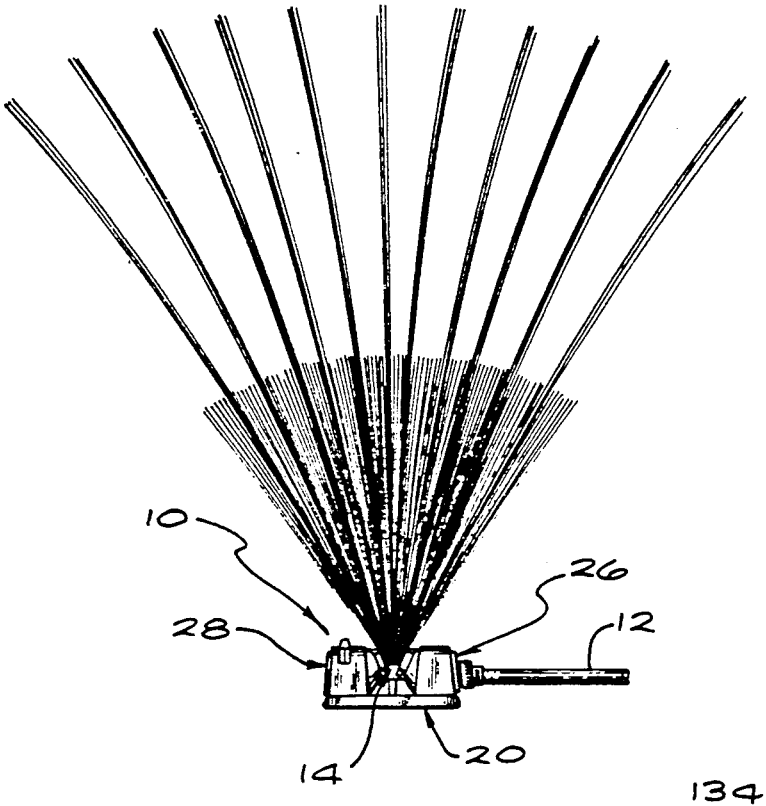
FIG. 1 is a fragmentary perspective view of an adjustable oscillating wave-type sprinkler embodying the present invention, and schematically illustrating the water spray pattern produced therefrom.

As shown in the exemplary drawings, the present invention is embodied in a new and improved adjustable oscillating wave-type irrigation sprinkler 10 primarily intended for use in watering lawns, flowers, shrubs, and the like. In this instance, as shown in FIG. 1, the oscillator 10 is adapted to be coupled to a conventional garden hose 12 through which pressurized water is supplied, and produces a fan- or wave-shaped spray pattern which is oscillated about a horizontal axis from side to side to irrigate a rectangular shaped area of preselected size.

Figure 2:
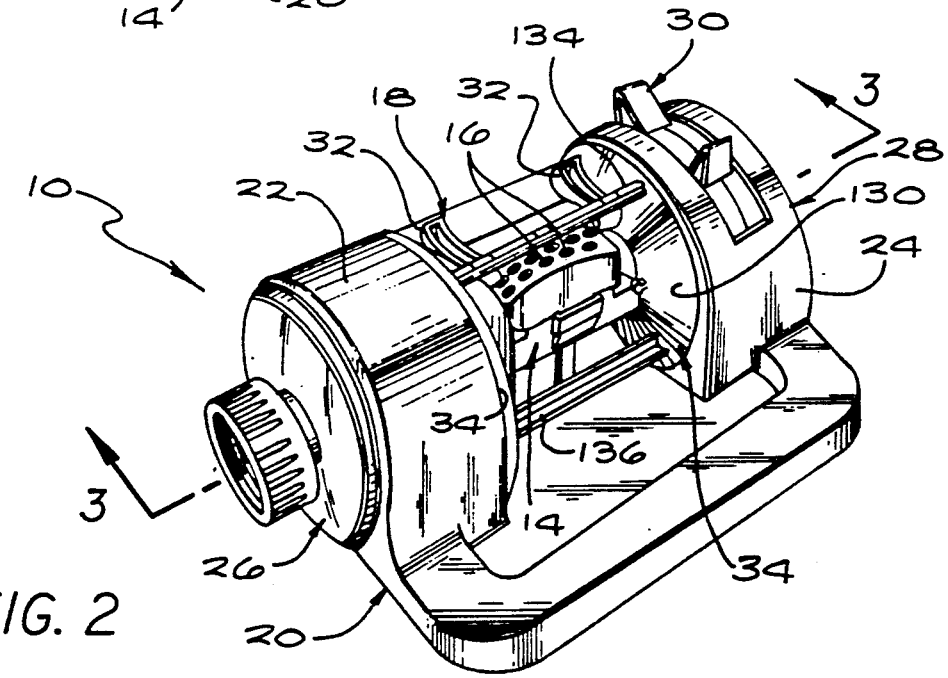
FIG. 2 is an enlarged perspective view of the adjustable oscillating wave-type sprinkler of FIG. 1 before attachment to a water supply hose.

Unlike conventional oscillating wave-type sprinklers which typically use water driven turbines or impellers mounted in a housing to oscillate an elongated spray tube, the oscillator 10 of the present invention employs a relatively short spray tube assembly, designated generally 14, having a plurality of nozzles 16, and which is oscillated about a horizontal axis from side to side by an externally located drive assembly, generally designated 18. With this construction, the oscillator 10 of the present invention is relatively simple and compact in design, and can be constructed in modular form for ease of manufacture and assembly, preferably from snap-together molded plastic parts. Toward these ends, as best seen in FIG. 2, the oscillator 10 includes a generally horizontal and flat base 20 for supporting the oscillator on the ground, and a pair of spaced, upstanding tubular shaped supports 22 and 24 to which are mounted the main components of the oscillator, including an inlet end housing section 26; an adjustment end housing section 28; the spray tube assembly 14; the drive assembly 18; and an arc adjustment mechanism 30.

In accordance with a principal aspect of the invention, the drive assembly 18 employs the principles of the well known impulse or impact drive-type mechanism herein including a pair of drive spoons 32 coupled to an impact arm assembly 34 rotatably mounted with respect to the base 20, and which operate by intercepting streams of water projected from the nozzles 16 of the spray tube assembly 14 to rotate the spray tube assembly about a horizontal axis. By use of the impact drive-type mechanism for the drive assembly 18, the area irrigated can be more uniformly watered since the drive spoons 32 can be used to disburse water laterally with respect to the streams from the spray tube assembly 14, and substantially instantaneous reversal of the direction of spray tube oscillation can be achieved. Further, since the streams from the spray tube assembly 14 which intercept the drive spoons 32 are disbursed, the nozzles of the spray tube assembly which drive the sprinkler can be of larger diameter, thereby permitting those sprays to be projected further to fill in the corners at the extremities of the oscillation cycle.

Figure 3:
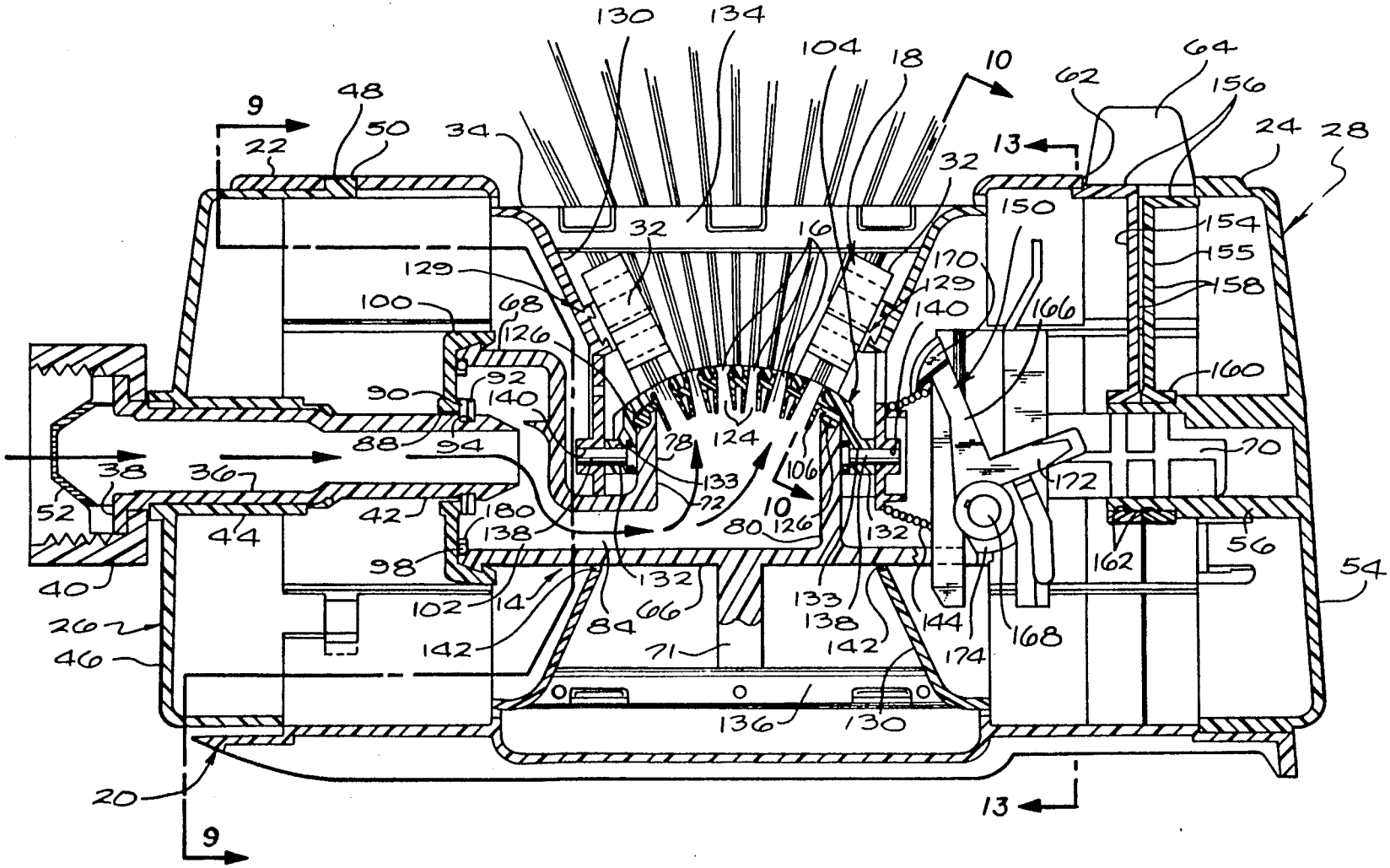
FIG. 3 is an enlarged sectional view taken substantially along line 3—3 of FIG. 2.
Figure 4:
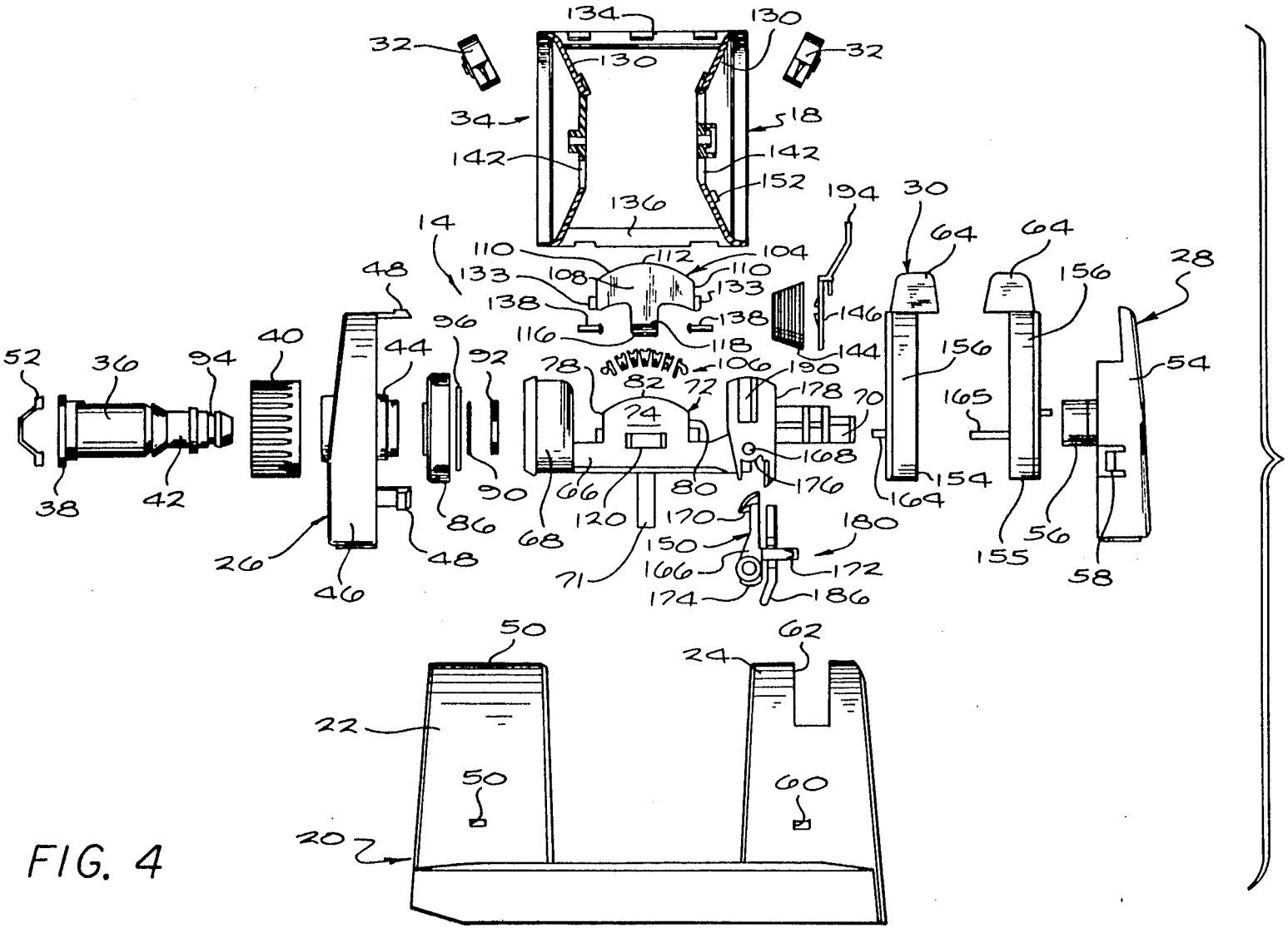
FIG. 4 is an exploded side plan view, partly in cross-section, of the components of the adjustable oscillating wave-type sprinkler of FIG. 1.

As best can be seen in FIGS. 3 and 4, water is supplied from the hose 12 to the oscillator 10 through a tubular inlet pipe 36 forming part of the inlet housing section 26, the inlet pipe having an outer flanged end 38 about which is rotatably disposed a hose coupling nut 40 for attachment to the supply hose, and an inner nipple portion 42 communicating with the spray tube assembly 14. The inlet pipe 36 is disposed to project horizontally through a central tubular boss 44 formed in a generally cup-shaped inlet housing 46, the housing herein having spaced radially projecting lock tabs 48 which mate with corresponding lock openings 50 formed in one of the upstanding supports, herein the left or inlet side support 22, to non-rotatably secure the inlet housing section to the base 20. To filter particulate material from the supply water before entering the oscillator 10, a filter screen 52 herein is mounted in the coupling nut 40 in line with the inlet pipe 36.

The adjustment end housing section 28 includes a cup-shaped adjustment housing 54 formed with a central tubular boss 56 which extends axially inwardly toward the spray tube assembly 14, and is non-rotatably secured to the other of the upstanding supports 24 by spaced radially projecting lock tabs 58 which mate with corresponding lock openings 60 formed in the support. Formed in the upper surface of the adjustment end support 24 is an elongated arcuate slot 62 through which project arc adjustment tabs 64 forming part of the arc adjustment mechanism 30, the description and operation of which will be further discussed hereinafter.

The spray tube assembly 14 is mounted for rotation between the inlet housing 26 and the adjustment housing 28, and includes an elongated body portion 66 having at one end an enlarged cylindrical inlet portion 68 mounted to the nipple portion 42 of the inlet pipe 36, and at the opposite end, an elongated cylindrical spindle portion 70 journaled for rotation within the tubular boss 56 of the adjustment housing 28. Projecting downwardly from the central portion of the body portion 66 is an elongated arm 71 which functions as an anvil engageable by the impact arm assembly 34 for incrementally rotating the spray tube assembly 14 in one direction about its axis.

As best seen in FIG. 5, centrally disposed between the inlet portion 68 and the spindle 70 is an upstanding, upwardly open and hollow generally box-shaped nozzle housing 72 formed, respectively, by generally flat side walls 74 and 76, spaced by generally flat inlet and outlet end walls 78 and 80, the upper ends 82 of the front and rear walls having a convex arcuate shape extending from the end walls so as to define a vertically convex opening having a generally rectangular horizontal cross-section. Interconnecting the inside of the hollow nozzle housing 72 and the inside of the cylindrical portion 68 is a close sided nozzle conduit 84 which functions to convey water from the inlet pipe 36 to the nozzle housing 72.

In the assembled condition, the cylindrical portion 68 is supported for rotation about the horizontal axis of the inlet pipe 36 through an end cap 86 which is snap fit over the inlet end of the cylindrical portion, and which includes a central cylindrical opening 88 journaled around the nipple portion 42 of the inlet pipe. Herein, a spindle thrust washer 90 and a sealing and bearing washer 92 are disposed in an annular groove 94 formed in the nipple portion 42 of the inlet pipe 36, and serve to rotatably retain the end cap 86 on the inlet pipe and seal the space between the pipe and the cylindrical opening 88 of the end cap. To seal the joint between the end cap 86 and the inlet end of the cylindrical portion 68, an O-ring 96 is mounted in an annular recess 98 formed around the inside of the inlet end of the cylindrical portion and compressively retained by an axially projecting ring 100 formed around the inside of the end cap near its outer periphery. With this construction, water entering the inlet pipe 36 is directed into a chamber 102 defined by the end cap 86 and the cylindrical portion 68, and is directed through the nozzle conduit 84 to the hollow nozzle housing 72.

To close the upper open end of the nozzle housing 72 and to form discrete water sprays, a nozzle cap 104 and nozzle strip 106 are secured to the nozzle housing. The nozzle cap 104 is herein formed as a molded cup-shaped element having generally flat side walls 108 spaced by lateral end walls 110, and closed by a top wall 112 formed with an array of nozzle openings 114 extending therethrough herein arranged in two side-by-side longitudinal rows. The side walls 108 and end walls 110 are dimensioned to overlie and surround the side walls 74 and 76, and inlet and outlet end walls 78 and 80 of the nozzle housing 72, and the top wall 112 is formed with a convex shape mating with that of the upper ends 82 of the nozzle housing so that when assembled with the nozzle housing, the nozzle cap 104 will overlie and enclose the convex open end of the nozzle housing. To secure the nozzle cap 104 to the nozzle housing 72, a pair of downwardly projecting locking tabs 116 formed with outwardly extending horizontal shoulders 118 are formed on each side wall 108 and which are snap-fit into mating radially projecting receptacles 120 formed on the side walls 74 and 76 of the nozzle housing.

The nozzle strip 106, best seen in FIGS. 3 and 8, is preferably formed from a molded flexible or resilient material such as rubber, and herein comprises a generally plate shaped rectangular carrier portion 122 through which the nozzles 16 are formed, the nozzles herein being formed by upwardly converging discrete passageways integrally formed as molded tubes 124 projecting vertically through the carrier portion. The carrier portion 122 is dimensioned to be frictionally retained inside the nozzle cap 104 with the molded tubes 124 aligned with the nozzle openings 114, and is herein formed with an enlarged peripheral rim 126 which serves to seal the interface between the upper end 82 of the nozzle housing 72 and the nozzle cap 104 when assembled.

Importantly, when the nozzle strip 106 is initially formed, the carrier portion 122 is formed in a flat condition with the axis of the nozzle tubes 124 each parallel to the other and perpendicular with the entire carrier portion. This facilitates molding of the nozzle strip 106 since straight core pin pulls can be used to form the converging nozzle passageways. When the nozzle strip 106 is positioned into the nozzle cap 104, the flexible carrier portion 122 of the strip will bend to conform with the convex shape of the end wall 112, thereby causing the nozzle tubes 124 to be reoriented in a fan-like array. This then forms an array of nozzles 16 which will produce a series of discrete water streams that diverge outwardly from the spray tube 14 in a fan-like pattern.

It is also important to note that use of a flexible molded nozzle strip 106 allows the spray tube assembly 14 to be very compact in size. In this respect, the nozzle tubes 124 are formed very close to each other on the carrier 122, and are arranged in two laterally off-set side-by-side rows, herein one row containing six nozzle tubes and the other five nozzle tubes. Due to the flexible nature of the nozzle strip 106 and the formation of the nozzle passageways as tubes 124 projecting through the carrier 122, the radius of curvature of the end wall 112 of the nozzle cap 104 can be relatively large, thereby permitting the angles of the re-oriented tubes when the strip is assembled into the cap to diverge relative to each other an extent sufficient to produce the desired fan shaped spray. This eliminates the need for an elongated spray tube with serially arranged nozzle openings, as was heretofore required for forming a fan-shaped spray in many prior art oscillator sprinklers.

To drive the oscillator 10 in side-to-side oscillation, herein the opposed two end nozzles 124A are formed to have a larger diameter than the remaining nozzles so that they produce larger diameter streams. Each of these drive nozzles 124A is disposed to eject its stream to intercept one of the drive spoons 32 forming part of the drive assembly 18. The drive spoons 32, which preferably are of the type disclosed in U.S. Pat. No. 4,182,494 issued Jan. 8, 1980 to Wichman et. al. and entitled ANTI-SIDE SPLASH DRIVE ARM FOR AN IMPACT DRIVE SPRINKLER, the disclosure of which is hereby incorporated herein by reference, operate to oscillate the spray tube assembly 14 about the horizontal axis of the oscillator 10.

As best seen in FIG. 3 and 4, the drive spoons 32 are each attached to the impact arm assembly 34, herein by a snap-fit dove tail type connection 129, the impact arm assembly comprising a pair of radially projecting, generally disk-shaped walls 130 laterally spaced by a pair of upper and lower axially extending bars 134 and 136, the lower of which serves as an impact hammer for striking the anvil 71 of the spray tube assembly 14. The disk-shaped walls 130, which herein have a slightly frusto-conical shape covering axially inwardly toward each other, are rotatably mounted to the spray tube assembly 14 for free rotation about the horizontal axis relative to the spray tube assembly. In this instance, the impact arm assembly 34 is journaled to the nozzle cap 104 by a pair of trunnion pins 138 which project through openings 132 formed through small bosses 133 projecting axially from the end walls 110 of the nozzle cap, and into axial bores 140 formed through the centers of the disk-shaped walls 130, arcuate semi-circular shaped openings 142 being formed in each disk-shaped wall to permit the body portion 66 of the spray tube assembly 14 to pass therethrough and remain stationary as the impact arm assembly 34 rotates on the trunnions 138 relative to the nozzle cap 104.

As can be seen in FIGS. 9 and 10, the drive spoons 32 are disposed on the impact arm disks 130 to initially deflect the streams from the drive nozzles 124A laterally of the nozzle assembly 14, and then re-deflects the streams upwardly in the general direction of the undeflected streams. Due to these deflections, and the relatively larger size of the drive nozzles 124A, the water exiting the drive spoons 32 tends to itself fan out, thereby producing their own fan shaped spray which helps to fill in the watered areas between the discrete streams from the undeflected nozzles 124 and improve over-all water distribution. Additionally, the undeflected streams from the drive nozzles 124A being larger in size than those of the remaining nozzle 124 throw further, thereby producing a more square-shaped water fall out pattern at the corners of the spray areas.

Due to the re-deflection of water by the drive spoons 32 back toward the undeflected spray directions, the water exerts a lateral force on the drive spoons producing a torque tending to rotate the drive spoons and attached impact arm assembly 34 out of the path of the water streams from the drive nozzles 124A. This causes the impact arm assembly 34 to rotate about the trunnions 138 in a counter-clockwise direction as seen in FIG. 9, and causes the drive spoons 32 to leave the path of the associated water streams from the drive nozzles 124A.

To store the energy of the impact arm assembly 34 as the drive spoons 32 are deflected out of the path of the streams from the drive nozzles 124A, an arm spring 144 is coupled between the impact arm assembly and the spindle portion 70 of the nozzle assembly 14. The arm spring 144, which herein is an axially disposed metal torsion coil spring, has one end attached to a disk-shaped plate 146 mounted to an enlarged radial mounting collar 148 formed on the spindle portion 70 of the spray tube body 66, and the opposite end attached to the adjacent disk-shaped wall 130 of the impact arm assembly 34 near the trunnion pin 138. The attachment of the spring 144 between the arm assembly 34 and the spray tube body 66 is initially made such that the spring exerts a pre-load force on the arm assembly tending to hold the drive spoons 32 in position to be intercepted by the streams from the drive nozzles 124A. As the arm assembly 34 rotates under the influence of the torque generated by reaction of the water on the drive spoons 32, the spring 144 absorbs and stores the arm energy, and, when the arm has reached the end of its rotary deflection, imparts the stored energy back to the arm to rotate the arm and attached drive spoons back towards the streams from the drive nozzles 124A.

As the arm spring 144 causes the impact arm assembly 34 to move the drive spoons 32 back into the path of the streams from the drive nozzles 124A, the leading edges 148 of the drive spoons intercept the water streams causing the streams to enter the spoons and undergo the initial lateral deflection. This initial stream interception and deflection produces a torque tending to pull the spoons further into the streams, as discussed in more detail in the aforementioned U.S. Pat. No. 4,182,494. Rotation of the impact arm assembly 34 and drive spoons 32 back into the streams from the drive nozzles 124A, in turn, causes the lower axially bar or hammer 136 to impact against the anvil 71 of the spray tube assembly 14, thereby causing an incremental rotation of the spray tube assembly about its horizontal axis, herein in a clockwise or forward direction as seen in FIG. 9. Repeated oscillation of the drive arm assembly 34 and drive spoons 32 into and out of the streams from the drive nozzles 124A produces continuous sequential incremental rotation of the spray tube assembly 14 in the clockwise direction about the horizontal axis of the oscillator 10.

When the spray tube assembly 14 reaches to desired end of its rotation in the clockwise direction shown in FIG. 9, the arc adjustment mechanism 30 operates to reverse the direction of spray tube rotation. Direction reversal of the spray tube assembly 14 is achieved by moving a reversing dog 150 into a position to engage an axially extending projection or reversing anvil 152 formed on the impact arm disk 130 adjacent the arm spring 144 to prematurely limit movement of the impact arm 34 and drive spoons 32 away from the drive nozzles 124A. As is well understood by those familiar with the operation of part circle impact drive sprinklers, by interrupting the swinging movement of the impact arm, a reverse torque can be applied to the sprinkler nozzle to effect reverse rotation, as for example, is discussed in the aforementioned U.S. Pat. No. 4,182,494.

In this case, as best can be seen in FIGS. 3, 4 and 12, the arc adjustment mechanism 30 includes a pair of axially spaced inner and outer ring shaped adjustment collars 154 and 155, respectively, each comprising an outer peripheral ring 156 interconnected by radial spokes 158 to an inner cylindrical mounting hub 160 which is rotatably mounted around the tubular boss 56 of the adjustment housing 28. Preferably, the inner surface 162 of the mounting hub 160 has a serrated or rough surface to frictionally yet releasably hold the adjustment collars 154, 155 in the desired rotary position relative to the tubular boss 56. Projecting upwardly from the outer peripheral ring 156 of each collar 154, 155 and extending through the arcuate slot 62 in the adjustment end support 24 are the adjustment tabs 64 by which the user can adjust the arcuate position of each of the collars 154, 155 with respect to the tubular boss 56. Extending axially inwardly from one of the radial spokes 158 of the inner and outer adjustment collars 154 and 155, respectively, is a reversing trip tab 164 and a forward trip tab 165 which operate to cause the reversing dog 150 to move into and out of position to be engaged by the reversing anvil 152 of the adjacent impact arm disk 130. As will become more apparent hereafter, by adjusting the rotary position of the adjustment rings 154, 155 relative to each other, the arc of oscillation of the spray tube assembly 14 can be controlled.

Figure 13:
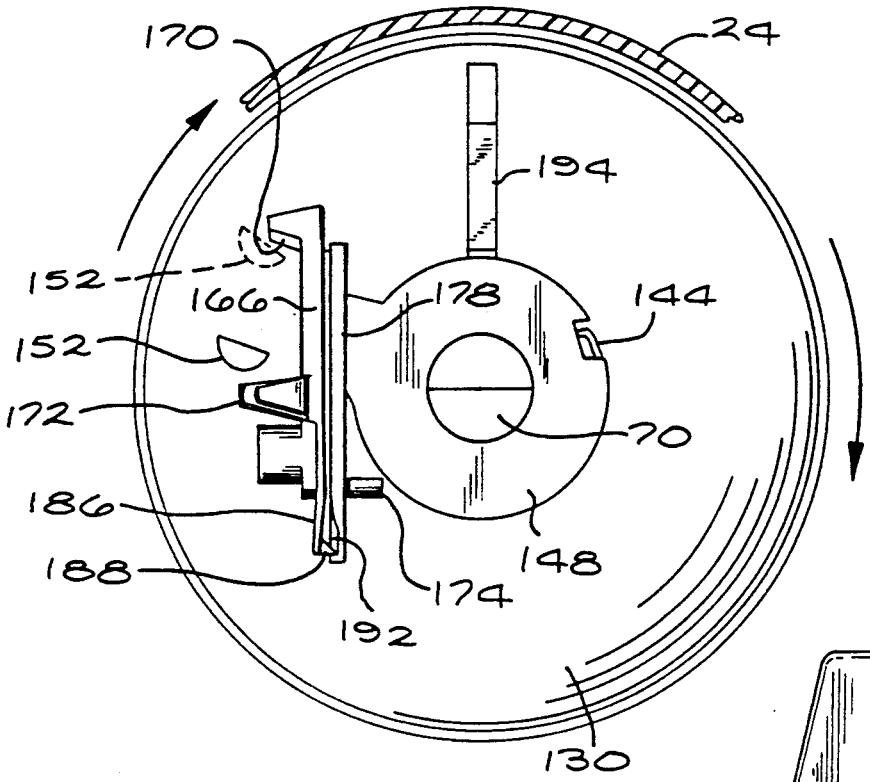
FIG. 13 is a fragmentary sectional view taken substantially along the line 13—13 of FIG. 3.
Figure 14:
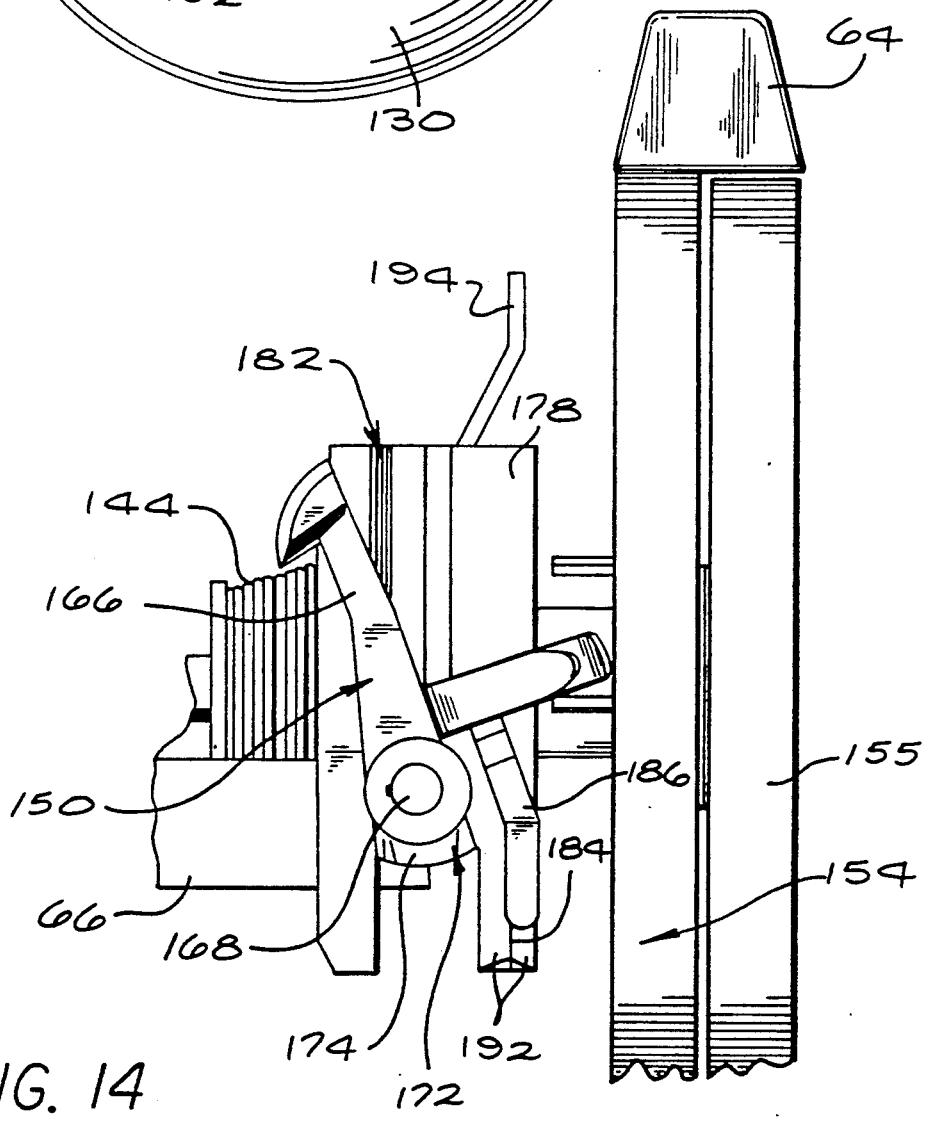
FIG. 14 is an enlarged fragmentary side elevational view similar to FIG. 11, but showing the reversing dog in another operative position.

With primary reference to FIGS. 11 through 14, the reversing dog 150 comprises a rocker arm 166 rotatably mounted on a cylindrical post 168 projecting radially and horizontally outwardly from the mounting collar 148 to which one end of the arm spring 144 and plate 146 is attached, and includes an angled impact surface 170 at the distal end thereof for engagement by the reversing anvil 152 of the impact arm disk 130. A trip pin 172 projects outwardly from the rocker arm 166 at a position laterally off-set to one side of the post 168, and is dimensioned to extend into operative relation for engagement by the trip tabs 164 and 165 of the adjustment rings 154, 155. Rotation of the rocker arm 166 about the post 168 is herein limited by a stop shoulder 174 which moves within a slot 176 formed in a cam plate 178 also attached to the mounting collar 148. With this arrangement, the rocker arm 166 can be limited to movement between a position where the impact surface 170 is out of position to be engaged by the reversing anvil 152 on the impact arm disk 130, as shown in FIG. 11, and in to the position where the impact surface will be engaged by the reversing anvil, as shown in FIG. 14.

To retain the reversing dog 150 in either the impact or non-impact position, a spring arm 180 and cooperating cam groove 182 arrangement is used and which causes the reversing dog 150 to effectively snap from one position to the other when the trip pin 172 is engaged by one of the trip tabs 164, 165. In this instance, the spring arm 180 comprises a downwardly projecting elongated flexible arm 186 extending laterally from the side of the trip pin 172, and which has a raised cam projection 188 at the termianl end. The cam projection 188 cooperates with a cam surface 192 formed in the cam plate 178 to hold the reversing dog 150 in either the engaged or disengaged positions. That is, as seen in FIGS. 13 and 14, the cam projection 188 follows the surface of the cam 192 which has a center ridge 184 with oppositely directed downwardly sloping sides so that the arm 186 must be flexed as the cam projection moves from one side of the ridge to the other in response to movement of the trip pin 172. The flexible arm 186 and its cam projection 188 thus act in cooperation with the sides of the cam 192 to frictionally retain the reversing dog 150 in either the engaged or the disengaged position.

When the spay tube assembly 14 is being driven in the forward or clockwise direction as viewed in FIG. 9, the spring arm 180 holds the reversing dog 150 in the position shown in FIG. 11. out of the path of the reversing anvil 152. When the spray tube assembly 14 reaches the desired end of its forward rotation about the horizontal axis, the trip pin 172 will engage the reversing trip tab 164 and cause the rocker arm 166 to rotate about its mounting post 168 to the position shown in FIG. 14. This moves the reversing dog 150 into the engagement position to cause the impact surface 170 to be engaged by the reversing anvil 152.

With the reversing dog 150 in position to be engaged by the reversing anvil 152, each time the drive spoons 32 rotate the impact arm assembly 34 out of the path of the streams from the drive nozzles 124A, the reversing anvil will strike the reversing dog 150 before the arm has moved a distance sufficient to have its energy dissipated and absorbed by the arm spring 144. The energy of the impact arm assembly 34 is thus transferred to the reversing dog 150, thereby causing the spray tube assembly 14 to rotate an incremental amount in the reverse or counter-clockwise direction as viewed in FIG. 9. Repeated oscillations of the impact arm assembly 14 with the reversing dog 150 in the engagement position produces continuous sequential incremental rotation of the spray tube assembly 14 about the horizontal axis in the reverse drive direction until the trip pin 172 reaches the forward trip tab 165 and rotates the reversing dog 150 out of position for engagement by the reversing anvil 152.

Notably, since the reversing dog 150 stops rotation of the impact arm assembly 34 prematurely, the spray tube assembly 14 is rotated incrementally much faster in the reverse drive direction that in the forward drive direction, thereby causing the drive spoons 32 to intercept the streams from the drive nozzles 124A more rapidly on each stroke. This has been found to increase the dispersion of the water from drive nozzles 124A and improving overall water distribution. Moreover, since the spring arm 180 snaps the reversing dog 150 into and out of the engagement position, reversal of the direction of oscillation of the spray tube assembly 14 is substantially instantaneous and the spray tube does not dwell at the extreme positions during transition from one direction of rotation to the other. This prevents overwatering at the extremes of the area being irrigated, again aiding to improving the overall water distribution.

To adjust the area to be irrigated by the oscillator 10, the user moves the adjustment tabs 64 along the slot 62 to rotate the adjustment collars 154 and 155 about this boss 56. Rotation of the collars 154 and 155 adjusts the arcuate position of the forward and reverse trip tabs 164, 165 relative to the reversing dog 150 and its associated trip pin 172. The larger the spacing between the adjustment tabs 64, the larger will be the spacing between the trip tabs 164, 165 and the greater the rotational arc which the spray tube assembly 14 will travel between direction reversals.

In the embodiment shown in the drawings, the reverse and forward trip tabs 164 and 165 are disposed to project outwardly from the trip collars 154, 155 at a position approximately 90 degrees in the clockwise direction as viewed in FIG. 12 from the positions of the adjustment tabs 64, and the arcuate slot 62 is formed to limit movement of the adjustment tabs to approximately 45 degrees to each side of the vertical. With this arrangement, by placing the adjustment tab 64 of the axially inner trip collar 154 in a vertical position with respect to the horizontal axis of the oscillation 10, and the outer trip collar 155 to the full counter-clockwise direction within the slot 62, the spray tube assembly 14 will oscillate between the vertical to a position approximately 45 degrees counter-clockwise therefrom, as viewed in FIG. 9. Thus the pattern of the area irrigated will be a rectangular area extending from the oscillator 10 outwardly on the counter-clockwise side only.

In a similar manner, movement of the outer adjustment collar 155 so that its adjustment tab 64 is vertical and the inner collar 154 so that its tab is in the full clockwise direction as viewed in FIG. 9, will produce a rectangular area to the clockwise side of the oscillator 10. By positioning of the adjustment tabs 64 of the inner and outer adjustment collars 154 and 155 in the full clockwise and counter-clockwise positions, respectively, the rectangular area watered will extend fully on both sides of the oscillator 10. Thus, the area to be watered can be quickly and easily controlled simply by adjusting the relative positions of the adjustment tabs 64, and that relative position will provide to the user a visual indicator of the area that the spray nozzle assembly 14 will cover with respect to the position of the oscillator 10.

As previously noted, the oscillator 10 of the present invention preferably is formed of snap-together molded parts which can be assembled in modular form. In this respect, the spray tube assembly 14 and drive assembly 18 can be assembled as a module by inserting the nozzle strip 106 into the nozzle cap 104, and then placing the trunnion pins 138 through the openings 132 in the cap. The nozzle cap 104 and attached trunnion pins 138 are then snap-fit over the nozzle housing 72. Thereafter, the impact arm assembly 34, with the drive spoons 32 attached thereto, can be mounted to the trunnion pins 138, the arm assembly preferably being formed as mating semi-circular members which can be joined together along the horizontal bars 134 and 136 by a suitable snap-fit connection so that the arm assembly surrounds the spray tube assembly 14. The reversing dog 150 can then be assembled on its mounting post 168, and the arm spring 144 and plate 146 coupled between the impact arm disk 130 and the spray tube assembly 14.

To facilitate assembly of the arm spring 144 and apply a preload, the mounting plate 146 to which one end of the spring is attached includes a lever 194 which can be held during assembly so that the opposite end of the spring can be first attached to the impact arm disk 130 and the spring coiled slightly to produce a preload force before the other end and attached plate are coupled to the spray tube assembly 14.

Both the inlet end housing section 26 and the adjustment end housing section 28 can similarly be formed as separate modules prior to final assembly of the oscillator 10. To form the inlet end housing section 26, the coupling nut 40 is positioned onto the inlet pipe 36 by sliding the nut over the nipple end 42 and seating it against the flange 38 and inserting the filter screen 52. Thereafter, the nipple portion 42 of the inlet pipe 36 is inserted through the tubular boss 44 of the inlet housing 46, and the end cap 86 installed and retained thereon by mounting the thrust washer 90 and bearing and sealing washer 92 into the groove 94 around the nipple portion. This module can then be snap-fit into the support 22 of the base 20 by mating the tabs 48 of the inlet housing 46 with the openings 50 of the support. Similarly, the adjustment end housing section 28 can be formed as a module by installing the arc adjusting rings 154 over the tubular boss 56.

The three modular units can then be finally assembled to complete the oscillator 10 by installing the O-ring 96 into the recess 98 of the end cap 86 and snap fitting the end cap to the inlet end of the cylindrical portion 68 of the spray tube assembly 14. Thereafter, the adjustment end housing section 28 is positioned into the support 24 of the base 20 so that the spindle portion 70 of the spray tube assembly 14 seats inside the tubular boss 56 and the arc adjustment tabs 64 project through the arcuate slot 62. The adjustment end housing section 28 is then secured to the support 24 by aligning the lock tabs 58 of the housing with the lock openings 60 of the support to complete the assembly process.

From the foregoing, it should be apparent that the oscillator 10 of the present invention is relatively simple and compact in design, inexpensive to manufacture and assemble, and effective in use. While a particular form of the invention has been illustrated and described, it should be apparent that variations and modifications can be made without departing from the spirit and scope of the invention as defined by the following claims. In this respect, while the present invention has been discussed in connection with the use of two drive spoons 32, any number drive spoons can be employed, and the precise form of the impact arm assembly, arc adjustment mechanisms, and spray tube assembly can be altered without departing from the general principles of the invention.

We claim:

1. In an oscillating wave irrigation sprinkler of the type primarily intended for use in watering lawns, flowers, shrubs, and the like, said sprinkler including a support base, a spray tube assembly rotatably mounted to said base for side-to-side oscillation about a generally horizontal axis, a plurality of individual spray openings formed in said spray tube, said openings being formed to eject discrete water streams outwardly of said spray tube in a fan-shaped spray pattern, and drive means for effecting limited side-to-side oscillation of said spray tube about said generally horizontal axis, the improvement wherein said drive means comprises:

an impact drive arm assembly mounted to said spray tube for rotation with respect thereto about said generally horizontal axis, said impact drive arm assembly including:

a drive spoon disposed to intercept the path of one of said discrete water streams from one of said spray openings thereby to rotate said drive arm relative to said spray tube and move said drive spoon away from the path of said one stream;

a spring means coupled between said drive arm and said spray tube, said spring means urging said drive spoon into the path of said one discrete water stream;

impact means on said drive arm for impacting said spray tube to impart incremental rotation to said spray tube in one direction with each return of said drive spoon into the path of said one stream; and reverse drive means for causing said impact drive assembly to effect incremental rotation of said spray tube in a direction opposite to said one direction when a preselected limit of oscillation in said one direction of rotation has been reached, thereby to drive said spray tube in limited side-to-side oscillation relative to said base about said generally horizontal axis.

2. The improvement as set forth in claim 1 wherein said reverse drive means includes a reversing anvil attached to said drive arm and a reversing dog coupled to said spray tube, said reversing dog being moveable between a forward drive position with said reversing dog out of the path of said reversing anvil and a reverse drive position for impact engagement with said reversing anvil.

3. The improvement as set forth in claim 2 wherein said reverse drive means includes selectively adjustable means coupled to said base for shifting said reversing dog between said forward and reverse drive positions.

4. The improvement as set forth in claim 3 wherein said selectively adjustable means comprises a pair of arc adjustment collars moveably mounted to said base, said arc adjustment collars including trip tabs for engaging said reversing dog to move said reversing dog between said forward and reverse drive positions.

5. The improvement as set forth in claim 4 wherein said arc adjustment collars are mounted to said base for independent relative rotation about said horizontal axis.

6. In an oscillating wave irrigation sprinkler of the type primarily intended for use in watering lawns, flowers, shrubs, and the like, said sprinkler including a support base, a spray tube assembly rotatably mounted to said base for side-to-side oscillation about a generally horizontal axis, a plurality of individual spray openings formed in said spray tube, said openings being formed to eject discrete water streams outwardly of said spray tube in a fan-shaped spray pattern, and drive means for effecting limited side-to-side oscillation of said spray tube about said generally horizontal axis, the improvement wherein said drive means comprises:

an impact drive assembly coupled to said spray tube for rotation relative thereto about said generally horizontal axis, said impact drive assembly including a drive arm having a pair of axially spaced drive spoons attached thereto, means mounting said drive arm to said spray tube for oscillating swinging rotation of each of said drive spoons about said axis and into intercepting engagement with one of said discrete water streams from one of said spray openings and into impact engagement with said spray tube, and spring means for urging said drive arm to swing said drive spoons toward intercepting engagement with said one of said water streams and impact engagement with said spray tube, whereby said impact drive assembly incrementally rotates said spray tube about said axis in a forward rotational direction relative to said base in a succession of relatively small steps;

a reversing mechanism mounted to said spray tube and including a reversing dog moveable between a forward drive position with said reversing dog out of the swinging path of rotation of said drive arm and a reverse drive position for impact engagement by said drive arm to rotate said spray tube stepwise in a reverse rotational direction; and means for shifting said reversing mechanism between said forward and reverse drive positions in response to rotational oscillation of said spray tube to an end limit of predetermined arcuate rotational path about said generally horizontal axis.

7. The improvement as set forth in claim 6 wherein said reverse drive means includes a reversing anvil attached to said drive arm and a reversing dog coupled to said spray tube, said reversing dog being moveable between a forward drive position with said reversing dog out of the path of said reversing anvil and a reverse drive position for impact engagement with said reversing anvil.

8. An oscillating wave sprinkler as set forth in claim 7 wherein said drive arm comprises a pair of generally radially disposed and axially spaced disk-shaped walls centrally journaled to said spray tube for rotation relative thereto about said axis, said disk-shaped walls being journaled to said spray tube adjacent opposed axial ends of said spray openings, and including means for impacting said anvil.

9. An oscillating wave sprinkler as set forth in claim 8 wherein each of said drive spoons is attached to one side of one of said disk-shaped walls facing toward said spray openings.

10. An oscillating wave sprinkler as set forth in claim 9 wherein one of said disk-shaped walls includes a reversing anvil engaging said reversing dog when said reversing mechanism is in said reverse drive position.

11. An oscillating wave sprinkler as set forth in claim 10 wherein said reversing anvil comprises a projection extending outwardly in an axial direction from the side of said disk-shaped wall opposite said one side.

12. The improvement as set forth in claim 11 wherein said reverse drive means includes selectively adjustable means coupled to said base for shifting said reversing dog between said forward and reverse drive positions.

13. The improvement as set forth in claim 12 wherein said selectively adjustable means comprises a pair of arc adjustment collars moveably mounted to said base, said arc adjustment collars including trip tabs for engaging said reversing dog to move said reversing dog between said forward and reverse drive positions.

14. The improvement as set forth in claim 13 wherein said arc adjustment collars are mounted to said base for independent relative rotation about said horizontal axis.

15. The improvement as set forth in claim 14 wherein said drive spoons are each attached to said drive arm at locations axially spaced on opposed sides of said spray openings, and said one of said spray openings comprise the spray openings disposed adjacent the axial ends of said spray tube.

16. The improvement as set forth in claim 15 wherein said spring means comprises a torsion spring coupled between said spray tube and said drive arm.

17. An oscillating wave irrigation sprinkler comprising:

a support base;

a spray tube assembly rotatably mounted to said base for side-to-side oscillation about a generally horizontal axis;

means for coupling said spray tube assembly to a source of pressurized water;

a plurality of individual spray openings formed in said spray tube, said openings being formed to eject discrete water streams outwardly of said spray tube in a fan-shaped spray pattern; and drive means for effecting limited side-to-side oscillation of said spray tube about said generally horizontal axis, said drive means including an impact drive assembly coupled to said spray tube for rotation relative thereto about said generally horizontal axis, said impact drive assembly including a drive arm having at least one drive spoon attached thereto, means mounting said drive arm to said spray tube for oscillating swinging rotation of said drive spoon about said axis and into intercepting engagement with one of said discrete water streams from one of said spray openings, and into impact engagement with said spray tube, and spring means for urging said drive arm to swing said drive spoon toward intercepting engagement with said one water stream and impact engagement with said spray tube, whereby said impact drive assembly incrementally rotates said spray tube about said axis in a forward rotational direction relative to said base in a succession of relatively small steps;

a reversing mechanism mounted to said spray tube and including a reversing dog moveable between a forward drive position with said reversing dog out of the swinging path of rotation of said drive arm and a reverse drive position for impact engagement by said drive arm to rotate said spray tube stepwise in a reverse rotational direction; and means coupled to said base for shifting said reversing mechanism between said forward and reverse drive positions in response to rotational oscillation of said spray tube to an end limit of predetermined arcuate rotational path about said generally horizontal axis.

18. An oscillating wave sprinkler as set forth in claim 17 wherein said spray tube assembly includes a generally hollow, axially elongated housing and having means to journal said housing to said base for side-to-side oscillation about said axis, said housing defining a convex upper surface through which said spray openings extend.

19. An oscillating wave sprinkler as set forth in claim 18 wherein said spray openings are formed as discrete spray nozzles arrayed along said upper surface.

20. An oscillating wave sprinkler as set forth in claim 19 wherein said spray nozzles are arrayed in a plurality of axially extending side-by-side rows to produce said fan-shaped spray pattern.

21. An oscillating wave sprinkler as set forth in claim 18 wherein one of said discrete spray nozzles has a size larger than the remaining nozzles, said larger nozzle producing said one water stream intercepted by said drive spoon.

22. An oscillating wave sprinkler as set forth in claim 21 wherein said larger size nozzle is disposed adjacent one axial end of said housing.

23. An oscillating wave sprinkler as set forth in claim 22 wherein said housing has a generally rectangular horizontal cross-section.

24. An oscillating wave sprinkler as set forth in claim 18 wherein said spray tube assembly includes an anvil coupled with said housing and engageable by said impact drive assembly to effect incremental forward rotation of said spray tube.

25. An oscillating wave sprinkler as set forth in claim 24 wherein said drive arm comprises a generally radially disposed disk-shaped wall centrally journaled to said spray tube for rotation relative thereto about said axis, said disk-shaped wall being journaled to said spray tube adjacent one axial end of said housing, and including means for impacting said anvil.

26. An oscillating wave sprinkler as set forth in claim 25 wherein said drive spoon is attached to one side of said disk-shaped wall facing toward said housing, and said means for impacting said anvil comprises an impact hammer projecting in the direction of said housing from said one side of said disk-shaped wall.

27. An oscillating wave sprinkler as set forth in claim 26 wherein said disk-shaped wall includes a reversing anvil engaging said reversing dog when said reversing mechanism is in said reverse drive position.

28. An oscillating wave sprinkler as set forth in claim 27 wherein said reversing anvil comprises a projection extending outwardly in an axial direction from the side of said disk-shaped wall opposite said one side.

29. An oscillating wave sprinkler as set forth in claim 28 wherein said means for shifting said reversing mechanism includes a pair of arc adjustment collars moveably mounted to said base, said arc adjustment collars including trip tabs for engaging said reversing dog to move said reversing dog between said forward and reverse drive positions.

30. An oscillating wave sprinkler as set forth in claim 29 wherein said arc adjustment collars are mounted to said base for independent relative rotation about said horizontal axis.

31. An oscillating wave sprinkler as set forth in claim 30 wherein said spring means comprises a torsion spring coupled between said spray tube and said drive arm.

32. An oscillating wave irrigation sprinkler comprising:

a support base;

a spray tube assembly rotatably mounted to said base for side-to-side oscillation about a generally horizontal axis;

means for coupling said spray tube assembly to a source of pressurized water;

a plurality of individual spray openings formed in said spray tube, said openings being formed to eject discrete water streams outwardly of said spray tube in a fan-shaped spray pattern; and drive means for effecting limited side-to-side oscillation of said spray tube about said generally horizontal axis, said drive means including an impact drive assembly coupled to said spray tube for rotation relative thereto about said generally horizontal axis, said impact drive assembly including a drive arm having a pair of axially spaced drive spoons attached thereto, means mounting said drive arm to said spray tube for oscillating swinging rotation of each of said drive spoons about said axis and into intercepting engagement with one of said discrete water streams from one of said spray openings, and into impact engagement with said spray tube, and spring means for urging said drive arm to swing said drive spoon toward intercepting engagement with said one water stream and impact engagement with said spray tube, whereby said impact drive assembly incrementally rotates said spray tube about said axis in a forward rotational direction relative to said base in a succession of relatively small steps;

a reversing mechanism mounted to said spray tube and including a reversing dog moveable between a forward drive position with said reversing dog out of the swinging path of rotation of said drive arm and a reverse drive position for impact engagement by said drive arm to rotate said spray tube stepwise in a reverse rotational direction; and means coupled to said base for shifting said reversing mechanism between said forward and reverse drive positions in response to rotational oscillation of said spray tube to an end limit of predetermined arcuate rotational path about said generally horizontal axis.

33. An oscillating wave sprinkler as set forth in claim 32 wherein said spray tube assembly includes a generally hollow, axially elongated housing, and including means to journal said housing to said base for side-to-side oscillation about said axis, said housing defining a convex upper surface through which said spray openings extend.

34. An oscillating wave sprinkler as set forth in claim 33 wherein said spray openings are formed as discrete spray nozzles arrayed along said upper surface.

35. An oscillating wave sprinkler as set forth in claim 34 wherein said spray nozzles are arrayed in a plurality of axially extending side-by-side rows to produce said fan-shaped spray pattern.

36. An oscillating wave sprinkler as set forth in claim 35 wherein two of said discrete spray nozzles have a size larger than the remaining nozzles, said larger nozzles producing said ones of said water streams intercepted by said drive spoons.

37. An oscillating wave sprinkler as set forth in claim 36 wherein said larger size nozzles are each disposed adjacent opposed axial ends of said housing.

38. An oscillating wave sprinkler as set forth in claim 37 wherein said housing has a generally rectangular horizontal cross-section.

39. An oscillating wave sprinkler as set forth in claim 38 wherein said said discrete spray nozzles are formed as nozzle openings through a flexible strip having a generally rectangular horizontal cross-section and coupled to said upper surface of said housing.

40. An oscillating wave sprinkler as set forth in claim 38 wherein said flexible material is an elastomeric material.

41. An oscillating wave sprinkler as set forth in claim 33 wherein said spray tube assembly includes an anvil coupled with said housing and engageable by said impact drive assembly to effect incremental forward rotation of said spray tube.

42. An oscillating wave sprinkler as set forth in claim 41 wherein said drive arm comprises a pair of generally radially disposed interconnected disk-shaped walls centrally journaled to said spray tube for rotation relative thereto about said axis, said disk-shaped walls being journaled to said spray tube adjacent opposed axial ends of said housing, and including means for impacting said anvil.

43. An oscillating wave sprinkler as set forth in claim 42 wherein each of said drive spoons is attached to one side of one of said disk-shaped walls facing toward said housing, and said means for impacting said anvil comprises an impact hammer coupled to said interconnected disk-shaped walls.

44. An oscillating wave sprinkler as set forth in claim 42 wherein one of said disk-shaped walls includes a reversing anvil engaging said reversing dog when said reversing mechanism is in said reverse drive position.

45. An oscillating wave sprinkler as set forth in claim 44 wherein said reversing anvil comprises a projection extending outwardly in an axial direction from the side of said one disk-shaped wall opposite said one side.

46. An oscillating wave sprinkler as set forth in claim 45 wherein said means for shifting said reversing mechanism includes a pair of arc adjustment collars moveably mounted to said base, said arc adjustment collars including trip tabs for engaging said reversing dog to move said reversing dog between said forward and reverse drive positions.

47. An oscillating wave sprinkler as set forth in claim 46 wherein said arc adjustment collars are mounted to said base for independent relative rotation about said horizontal axis.

48. An oscillating wave sprinkler as set forth in claim 42 wherein said spring means comprises a torsion spring coupled between said spray tube and said drive arm.

49. An oscillating wave sprinkler as set forth in claim 48 wherein said spray openings are formed as discrete spray nozzles arrayed along said upper surface.

50. An oscillating wave sprinkler as set forth in claim 49 wherein said spray nozzles are arrayed in a plurality of axially extending side-by-side rows to produce said fan-shaped spray pattern.

51. An oscillating wave sprinkler as set forth in claim 50 wherein two of said discrete spray nozzles have a size larger than the remaining nozzles, said larger nozzles producing said ones of said water streams intercepted by said drive spoons.

52. An oscillating wave sprinkler as set forth in claim 41 wherein said larger size nozzles are each disposed adjacent opposed axial ends of said housing.

53. An oscillating wave sprinkler as set forth in claim 52 wherein said housing has a generally rectangular horizontal cross-section.

54. An oscillating wave sprinkler as set forth in claim 53 wherein said said discrete spray nozzles are formed as nozzle openings through a flexible strip having a generally rectangular horizontal cross-section and coupled to said upper surface of said housing.

55. An oscillating wave sprinkler as set forth in claim 54 wherein said flexible material is an elastomeric material.

* * * * *